US007064712B2

(12) United States Patent
Munk

(10) Patent No.: US 7,064,712 B2
(45) Date of Patent: Jun. 20, 2006

(54) MULTILAYERED SLOT-COUPLED ANTENNA DEVICE

(75) Inventor: Marco Munk, Aichwald-Aichschiess (DE)

(73) Assignee: Marconi Communications GmbH, Backnang (DE)

( * ) Notice: Subject to any disclaimer, the term of this patent is extended or adjusted under 35 U.S.C. 154(b) by 0 days.

(21) Appl. No.: 10/469,803

(22) PCT Filed: Feb. 25, 2002

(86) PCT No.: PCT/IB02/00582

§ 371 (c)(1),
(2), (4) Date: Mar. 1, 2004

(87) PCT Pub. No.: WO02/071543

PCT Pub. Date: Sep. 12, 2002

(65) Prior Publication Data

US 2004/0125021 A1 Jul. 1, 2004

(30) Foreign Application Priority Data

Mar. 5, 2001 (EP) ..... 01105286

(51) Int. Cl.
*H01Q 1/38* (2006.01)

(52) U.S. Cl. ..... 343/700 MS; 343/846

(58) Field of Classification Search ..... 343/700 MS, 343/846, 848, 850, 858, 853
See application file for complete search history.

(56) References Cited

U.S. PATENT DOCUMENTS

| | | | | |
|---|---|---|---|---|
| 5,043,738 | A * | 8/1991 | Shapiro et al. | 343/700 MS |
| 5,241,321 | A * | 8/1993 | Tsao | 343/700 MS |
| 5,355,143 | A | 10/1994 | Zurcher et al. | 343/700 MS |
| 5,668,558 | A * | 9/1997 | Hong | 343/700 MS |
| 5,844,523 | A | 12/1998 | Brennan et al. | 343/700 MS |
| 6,018,319 | A * | 1/2000 | Lindmark | 343/700 MS |
| 6,107,965 | A * | 8/2000 | Christ | 343/700 MS |
| 6,377,217 | B1 * | 4/2002 | Zhu et al. | 343/700 MS |
| 6,531,984 | B1 * | 3/2003 | Johannisson et al. | 343/700 MS |

FOREIGN PATENT DOCUMENTS

FR 2 666 691 9/1990

* cited by examiner

*Primary Examiner*—Hoang V. Nguyen
(74) *Attorney, Agent, or Firm*—Kirschstein, et al.

(57) ABSTRACT

A multilayered slot-coupled antenna device employs a push-pull arrangement of at least two slot-feedline pairs, whereby the feed lines are driven from a common signal source and configured such that changes in antenna center-frequency and input impedance due to layer offsets are largely compensated.

17 Claims, 6 Drawing Sheets

MULTILAYERED SLOT-COUPLED ANTENNA DEVICE

This application is a 371 of PCT/IB02/00582 dated 25 Feb. 2002.

This invention relates to a multilayered slot-coupled antenna device in which energy is transferred between a signal port and an antenna element through a slot formed in a metallization layer.

The feeding of an antenna element from a signal source may generally take place either through conduction (i.e. a direct connection between source and element) or through an electromagnetic coupling process, the latter including the so-called slot coupling technique. While the former is intrinsically simple and may be realised in a single-layer package, the latter requires the use of a multilayered metallization-plus-dielectric arrangement.

Multilayered slot-coupled antenna arrangements are in themselves well known, one example being shown in FIGS. 1*a* and 1*b*. In FIGS. 1*a* and 1*b* a multilayered structure comprises a substrate (dielectric carrier or foam) 10 and two dielectric layers 11, 12. Sandwiched between the substrate and the dielectric layer 11 is a signal feed-line 13 and sandwiched between the dielectric layers 11 and 12 is a ground plane 14 in which is formed a slot or aperture 15. Finally, an antenna element ("patch") 16 is deposited onto the upper surface of dielectric 12, while the underside of the substrate may be provided with a ground metallization layer 17.

A number of advantages flow from this type of arrangement. Firstly, because the greater part of the feed line is separated from the antenna patch via a grounded metallization layer, the spurious emission of radiation from the device is reduced. It is also possible to employ different dielectric materials with, for example, different dielectric constants on the two sides of the ground plane 14, so that the performance of the dielectric can be optimised for both the signal-feed part and the antenna part of the antenna device. The slot is dimensioned such that it does not give rise to resonance. Further, because coupling is via radiation through a slot, and not via conduction through conductors, the need for through-contacts ("vias") and bored holes to accommodate these is avoided.

However, one particular drawback with the use of a slot-coupled arrangement as opposed to a directly coupled arrangement is that tolerances which inevitably arise in the manufacture of the multilayer package can cause a deterioration in antenna performance, this mainly affecting the centre frequency of operation of the antenna and its input impedance characteristic.

In accordance with a first aspect of the invention there is provided a multilayered slot-coupled antenna device comprising: in sequence; an antenna element; a first dielectric layer; a ground plane having first and second coupling slots formed therein; a second dielectric layer; and first and second feed lines associated with respective coupling slots, characterised in that the first and second feed lines are connected to a signal-feed port by way of a power divider and the feed lines are configured such that each has a portion distant from the signal-feed port which crosses its respective slot orthogonally thereto, said portions pointing in opposite directions. Since the portions of the feed lines cross their respective coupling slot point in opposite directions any lateral displacement of the feed lines relative to their respective coupling slots during fabrication of the antenna will affect coupling in an opposite sense thereby reducing the effect of any displacement.

Advantageously the signal feed lines are arranged such that, in use and with reference to the locations of the feed lines at the slots, a signal applied to the signal-feed port is divided substantially equally between the feed lines and in opposite phases such that the phase of the feed signal at one slot differs from that of the feed signal at the other slot by substantially $\pi$ radians.

Advantageously in one embodiment the first and second coupling slots comprise elongate apertures spaced apart from each other and lying along a common axis and the first and second feed lines lie orthogonal to their respective apertures, the free-ends of the feed lines lying on opposite sides of the common axis.

Alternatively the first and second coupling slots comprise elongate apertures spaced apart and lying parallel to each other and the first and second feed lines lie orthogonal to their respective apertures, the free-ends of the feed lines pointing away from each other.

In a further alternative embodiment the first and second coupling slots comprise elongate apertures spaced apart and lying parallel to each other and the first and second feed lines have respective first portions lying orthogonal to, and respective continuing portions lying parallel to, the respective apertures.

Advantageously the antenna device further comprises third or more coupling slots formed in the ground plane and third or more feed lines associated with respective third or more coupling slots and connected to at least one further signal-feed port.

In a particularly preferred embodiment the antenna device comprises third and fourth coupling slots and respectively associated third and fourth feed lines, the third and fourth feed lines being connected to a further signal-feed port by way of a further power divider.

With such an arrangement the antenna element is advantageously rectangular in form and the first and second coupling slots lie opposite each other near two of the edges of the rectangular element and the third and fourth coupling slots lie opposite each other near the other two edges of the rectangular antenna element, the feed lines having portions which lie orthogonal to their respective coupling slots.

Embodiments of the invention will now be described, by way of example only, with reference to the drawings, of which:

FIGS. 1*a* and 1*b* show, in sectional side view and exploded plan view, respectively, the construction of a conventional multilayered slot-coupled antenna device;

FIG. 2 illustrates the appearance of oppositely directed inaccuracies (offsets) in the positioning of the feed line relative to the slot in one direction only;

FIGS. 3*a* and 3*b* are a graph of input reflection factor versus frequency and a Smith Chart, respectively, relating to the change in performance of a particular realisation of a known antenna device due to offsets;

FIG. 4 is a first embodiment of an antenna device in accordance with the invention;

FIGS. 5*a* and 5*b*; are a graph of input reflection factor versus frequency and a Smith Chart, respectively, for the antenna device of FIG. 4;

Figure 1A:
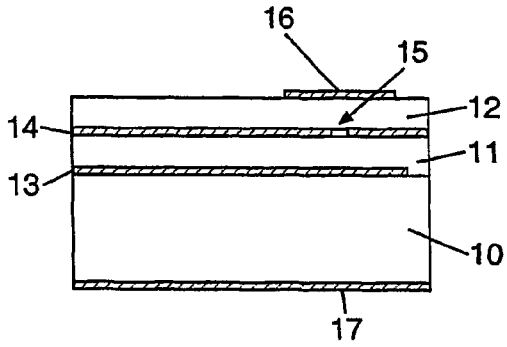
Figure 1B:
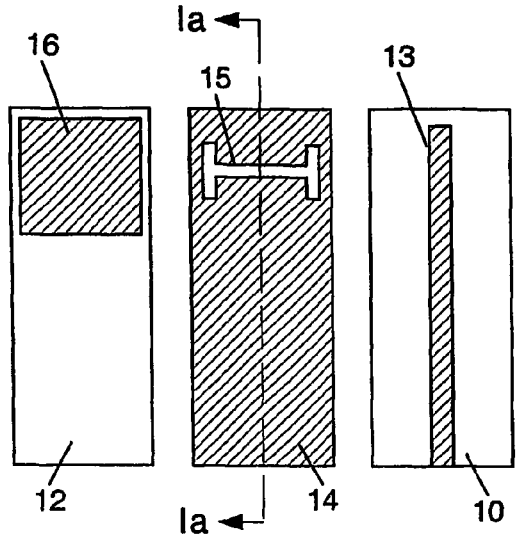
Figure 2:
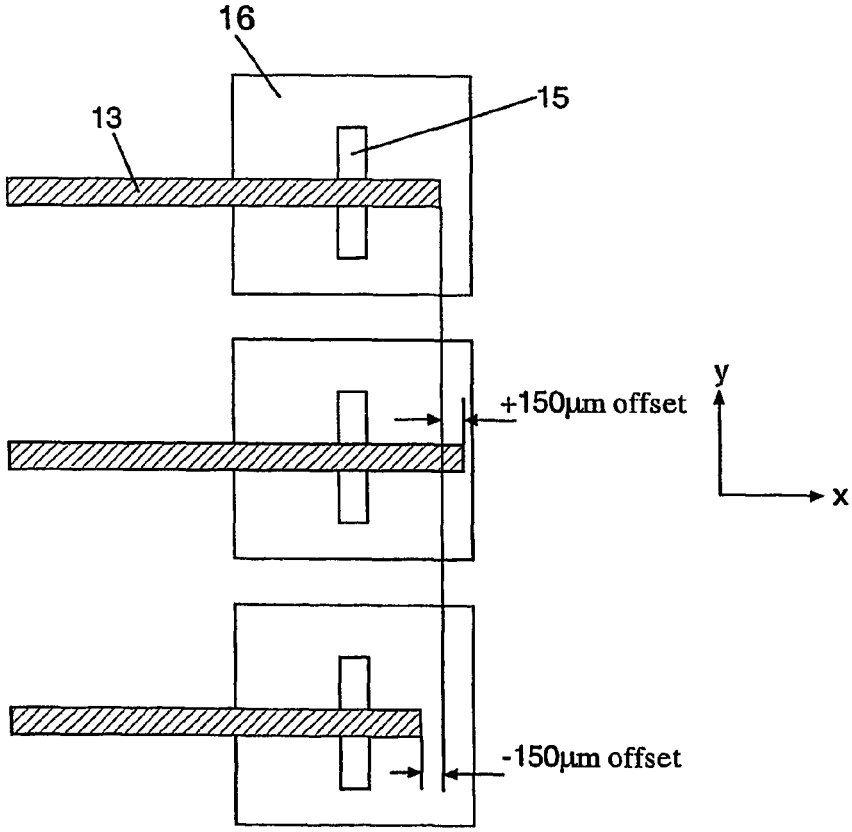

With the aid of FIGS. 1*a*, 1*b* and 2, the effect of tolerances in the production of multilayer packages will now be described.

The manufacturing steps in the production of an antenna device in accordance with the invention are, in one realisation, as follows: (a) the feed line 13 is deposited onto the dielectric 11, leaving the other side of the dielectric 11 unmetallized; (b) the ground plane 14 is deposited onto the dielectric 12 and the slot 15 then formed in the ground plane; (c) the patch 16 is deposited onto the other side of the dielectric 12; (d) one side of the substrate 10 is completely metallized 17, the other side is left unmetallized. Finally, (e) the dielectric 11, dielectric 12 and substrate 10 are secured to each other by means of, for example, an adhesive process. A problem which arises is that an exact positioning of the dielectrics 11 and 12 relative to each other cannot be guaranteed and this gives rise to the tolerances mentioned earlier. Positioning inaccuracies, displacements or "offsets", can occur in two directions along the plane of the antenna patch 16 and this is illustrated in FIG. 2, in which the offset directions are characterised as x and y. While it would normally be desirable to avoid offsets in either of these directions, those in the x direction (i.e. orthogonal to the slot) are to be particularly avoided, since they lead to a considerable detuning of the antenna resonance frequency or, expressed in different terms, to a marked shift in the input impedance of the antenna. These effects are even more pronounced at higher frequencies.

Figure 3A:
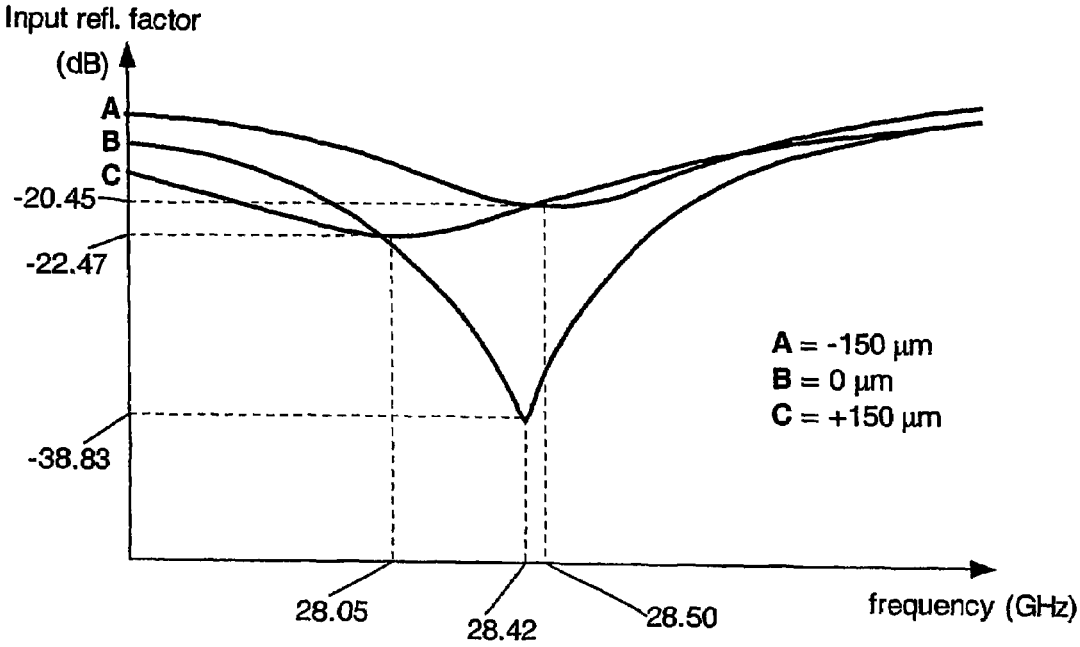
Figure 3B:
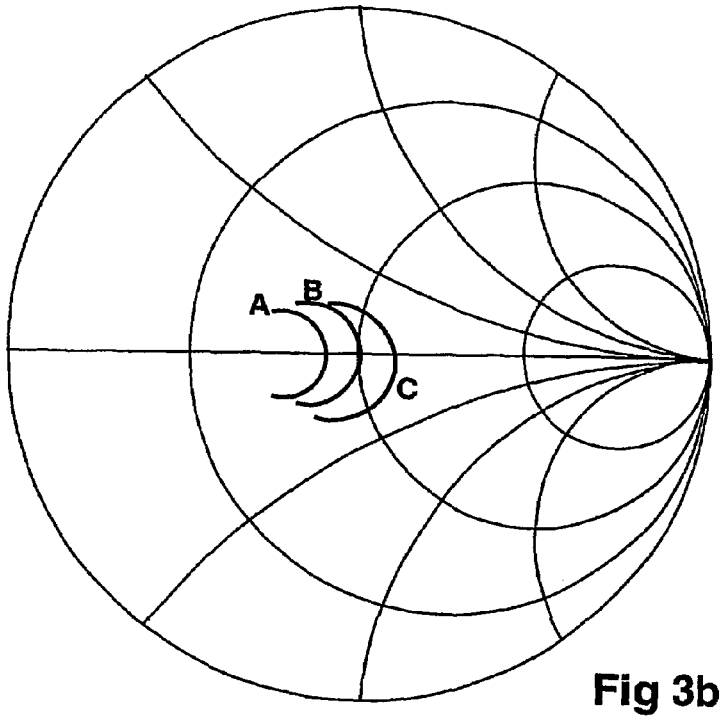

A concrete example of such a deleterious effect on antenna performance is shown in FIGS. 3*a* and 3*b*, which relate to a nominal antenna operation frequency of around 28 GHz (28.42 GHz) and to a displacement or "offset" of layers of +/−150 μm in the x direction. The change in the input reflection factor characteristic with frequency is the subject of FIG. 3*a*, where it can be seen that, while a dip in the characteristic of approximately 39 dB is achieved at zero offset, the situation is between 16 and 19 dB worse when the cited offset occurs. Furthermore, the centre frequency of the antenna shifts from its nominal value (28.42 GHz) to values either side of this nominal value due to the offsets, the overall spread in resonance frequency being approximately 450 MHz. The same situation is shown in different form in the Smith Chart of FIG. 3*b*.

It has been found that this deterioration in performance is due to the fact that the feed line functions as a stub having certain nominal impedance characteristics. Any change in the length of the stub changes those characteristics and affects, as a consequence, the overall operation of the antenna device.

The solution provided by the present invention is to employ at least two feed lines in conjunction with respective slots and to arrange for these two or more pairs of components to act in a push-pull configuration, thereby cancelling out any offset in the package layers.

Figure 4:
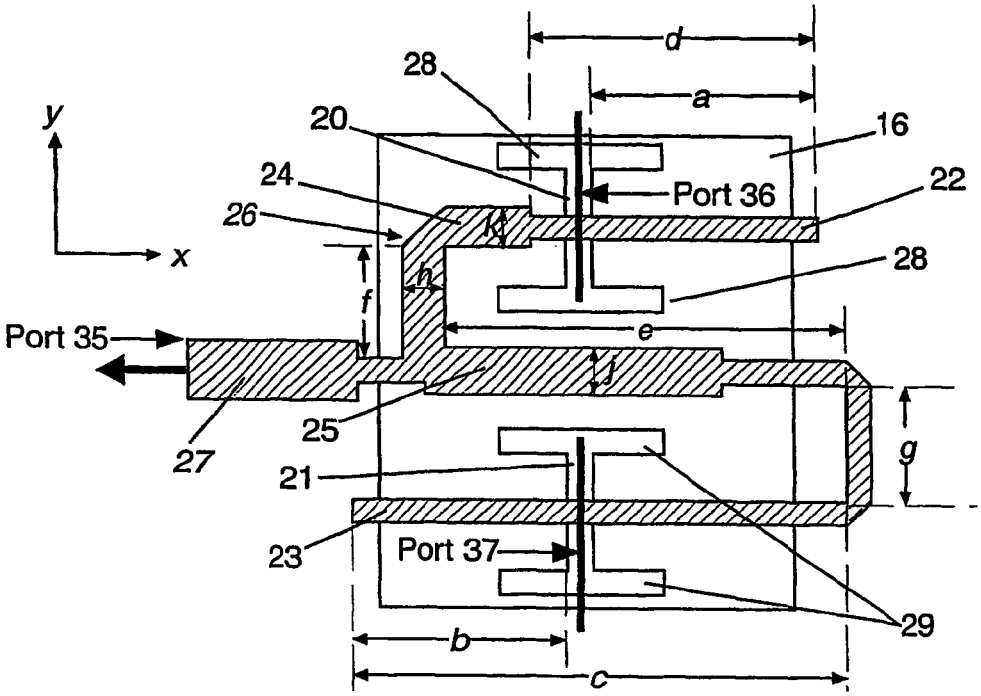

A first example of an antenna arrangement embodying the invention is illustrated in FIG. 4, in which the footprint of the patch 16 encompasses two slots 20, 21 and two respectively associated lines 22, 23. The feed lines 22, 23 are connected to respective transmission lines 24, 25 for impedance transformation purposes and the latter are in turn coupled to a line section 27, the free end of which functions as a port 35. Components 24, 25 and 27 together represent a power splitter 26 which may, as in this case, take the form of the well-known malformed T-junction.

In use, the input signal starts at port 35 and is divided into two parts carried by lines 22 and 23, respectively. In a preferred embodiment of the invention two conditions are observed, which are now explained with reference to the existence of two virtual ports: port 36 on line 22 and port 37 on line 23. The first condition is that the power transmitted from port 35 to port 36 is of substantially equal magnitude to that transmitted from port 35 to port 37. In terms of S-parameters (transmission magnitude):

$$|S_{port36,\ port35}|(dB)=|S_{port37,\ port35}|(dB)=-3\ dB\ \text{(loss-free)}$$

In addition the difference between the phase at port 36 compared with that at port 37 is |π|, in the manner of a push-pull feed under the slots 20, 21. In S-parameter terms (transmission phase):

$$\text{phase}\ (S_{port36,\ port35})-\text{phase}\ (S_{port37,\ port35})=|\pi|$$

The push-pull signals under the slots 20, 21 in combination with opposite-feeding directions (port 36 from the left-hand side, port 37 from the right-hand side) result in an additive feeding of the patch 16 through the two slots 20, 21. The practical realisation of the various components of the antenna device, i.e. determination of the lengths d, c of the feed lines, lengths and widths of the slots, overhangs d, b of the coupling lines beyond the slots, widths h, j, k of the malformed T-junction, lengths f, g of the limbs, etc, will follow already well established principles, for example as outlined in "Handbook of Microstrip Antennas" by J. R. James and P. S. Hall, Peter Peregrinus, London, 1989, and will not be described further in this patent application.

In order to save space in the package, the slots 20, 21 are provided at each end with extension portions 28, 29, this serving to increase the effective length of the slots in a manner described in, for example, "Broadband Patch Antennas" by Jean-François Zürcher and Fred E. Gardiol, Artech House, Boston, 1995.

Figure 5A:
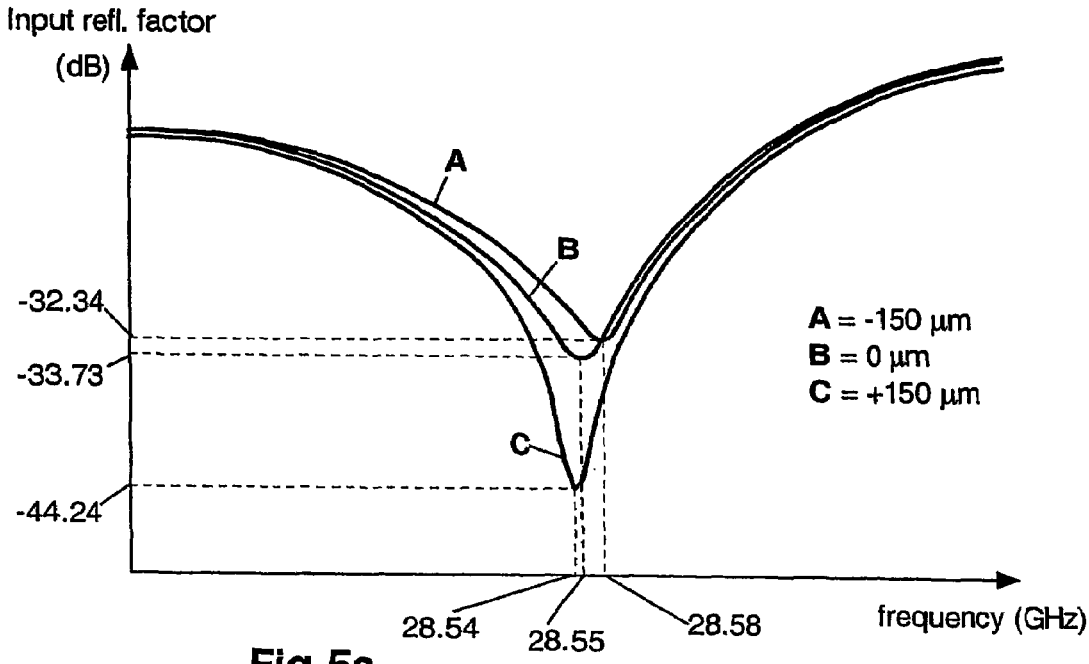
Figure 5B:
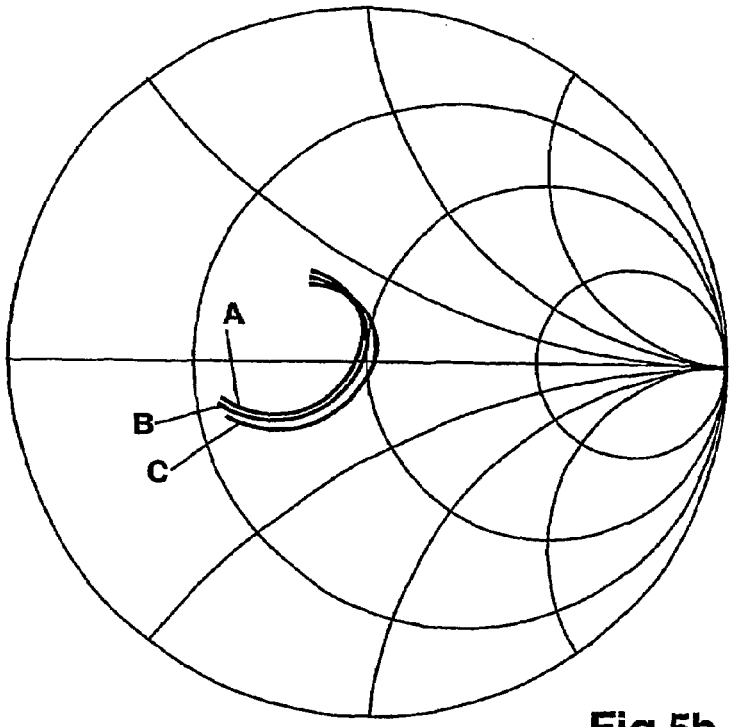

With the arrangement just described, any offset in the x-direction will affect both slots in tandem (push-pull configuration), there resulting a lengthening of one stub and a corresponding shortening of the other, so that as a result the net effect is greatly reduced and the frequency and impedance characteristics of the antenna device is maintained more nearly constant. FIGS. 5*a* and 5*b* show the resulting performance in graphical/chart form, where it can be seen that the required dip in input reflection factor, while not absolutely constant in all three cases (i.e. −150 μm, 0 μm and +150 μm), is nevertheless far less affected by the offsets. The actual change in input impedance over the total offset range is now approximately 50.6Ω−48.1Ω=2.5Ω, a change of only 5.0%. This should be compared with a variation of between 57.7Ω and 41.4Ω (32.6%) in the uncompensated arrangement (FIGS. 3*a* and 3*b*). The corresponding change in centre frequency is 40 MHz, which amounts to a 0.14% change as opposed to 1.58% in the uncompensated case.

Figure 6:
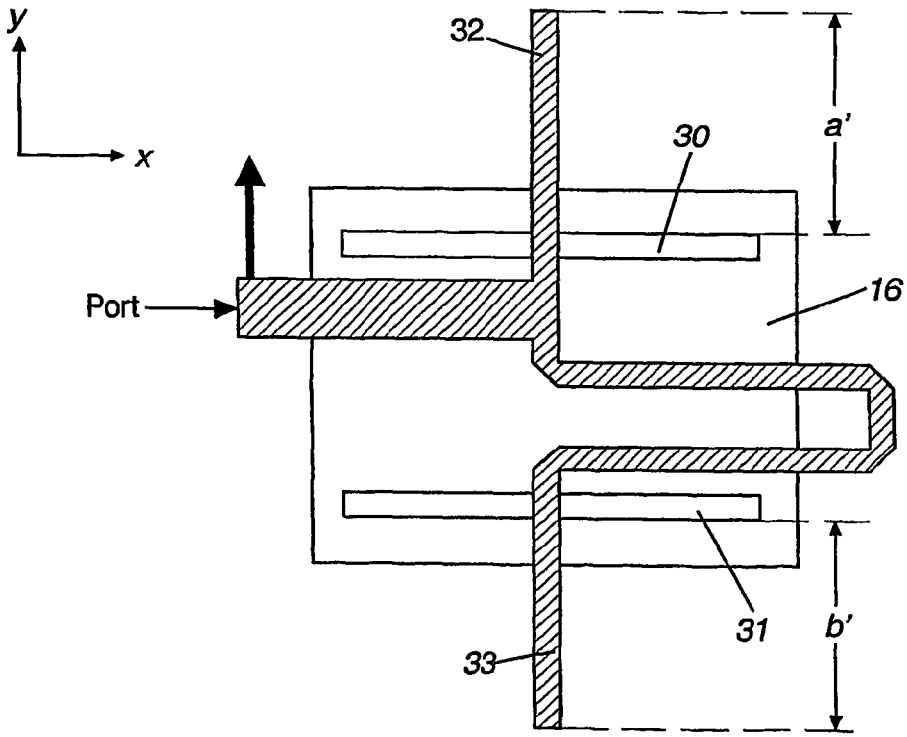
FIG. 6 is a second embodiment of an antenna device in accordance with the invention.
Figure 7:
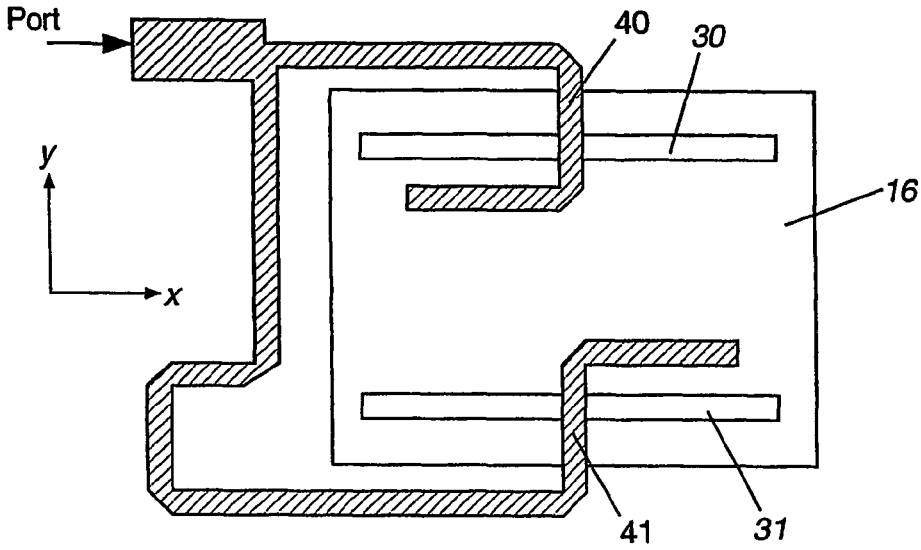
FIG. 7 is an alternative version of the second embodiment of the invention.

Two alternative embodiments of the invention are illustrated in FIGS. 6 and 7, in which this time the slots 30, 31 occupy most of the length of the patch 16 in the x-direction and the feed lines 32, 33/40, 41 run in the y-direction. The compensated offsets in this case will lie in the y-direction instead of the x-direction. Again, driving of the feed lines will ideally comply with the two phase- and amplitude-related conditions outlined earlier.

Figure 8:
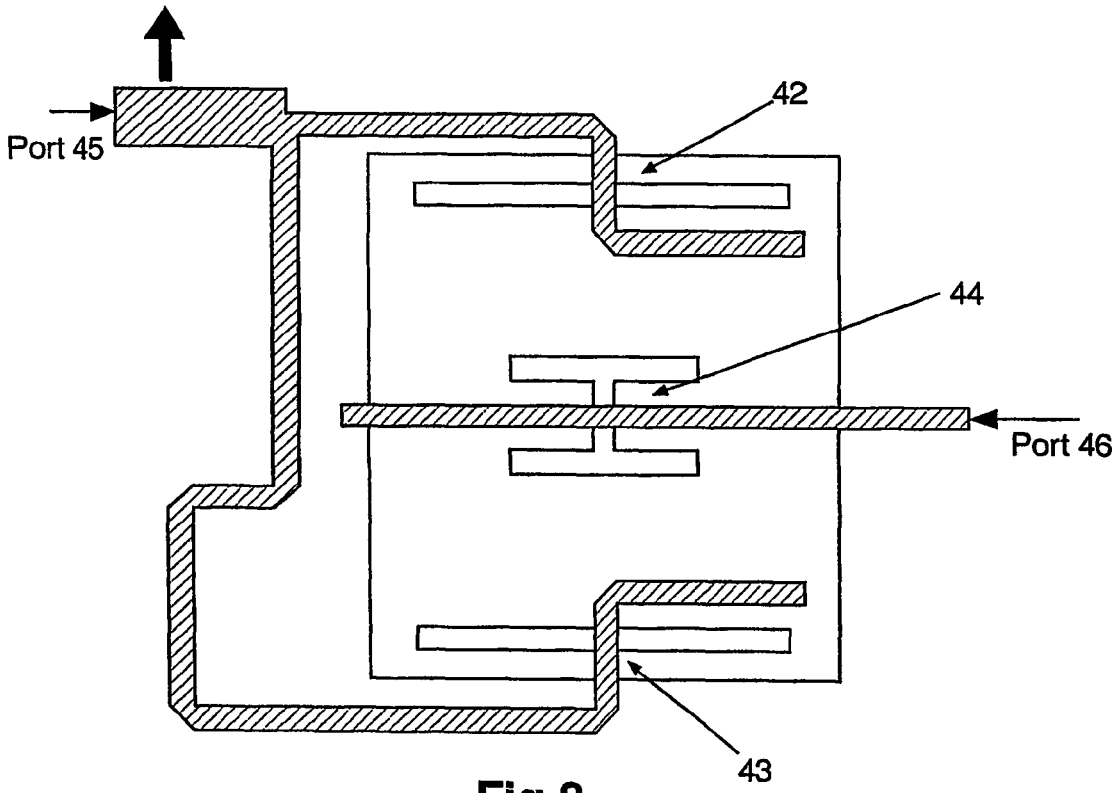
FIG. 8 is a third embodiment of an antenna device in accordance with the invention.
Figure 9:
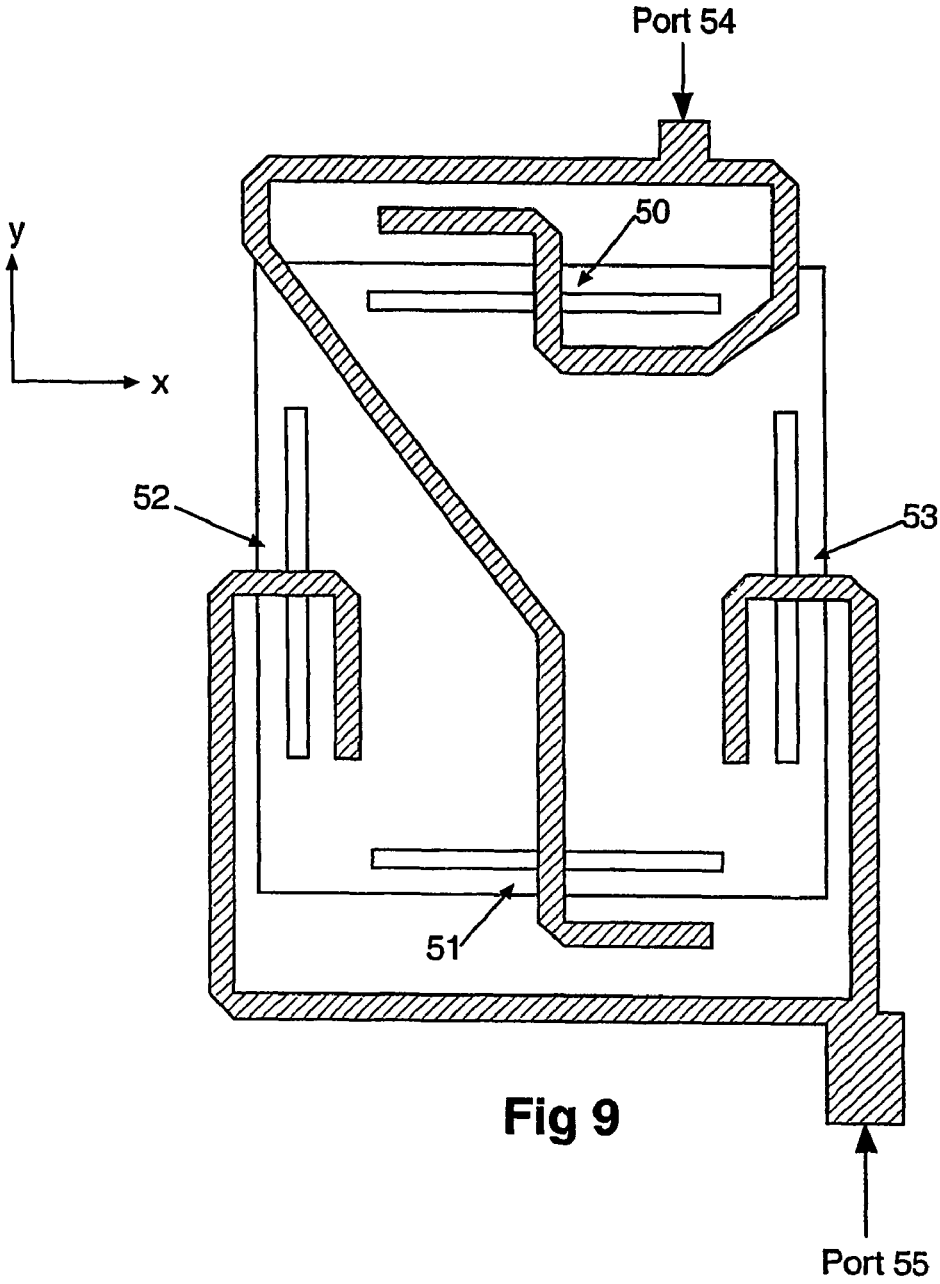
FIG. 9 is a fourth embodiment of an antenna device in accordance with the invention.

Although so far only antenna devices having two pairs of feed-lines and slots have been illustrated and described, the invention does also envisage the use of more than two. In FIG. 8 there is shown a realisation of the invention comprising a pair of feed-line/slot arrangements 42, 43 which operate in push-pull as already described in connection with the other embodiments, and an additional line/slot arrangement 44 which, while not contributing to the offset-compensation effect, does nevertheless provide the antenna with a signal feed operating under the opposite polarisation, i.e. in the x-direction, the advantage of this being that the patch may be fed with two different frequencies. Feeding the antenna are two ports 45, 46. In FIG. 9 a further embodiment employs slot/feed pairs 50, 51 configured in one polarisation and slot/feed pairs 52, 53 configured in the other polarisation, with input signals being applied to the respective ports 54 and 55, from where they are applied in push-pull to the slot-traversing portions of the respective feeds. Compensation for offsets now takes place in both x- and y-directions. As in the FIG. 8 arrangement, the two ports can be made to carry different frequencies, but this time both feed signals are made substantially insensitive to their respective associated offsets.

The invention claimed is:

1. A multilayered slot-coupled antenna device, comprising in sequence:

a) an antenna element;

b) a first dielectric layer;

c) a ground plane having first and second coupling slots formed therein, the coupling slots comprising elongate apertures spaced apart and extending along a common axis;

d) a second dielectric layer; and e) first and second feed lines connected to a signal-feed port through a power divider, the first feed line having a first line portion orthogonally crossing the first coupling slot in a first direction, the second feed line having a second line portion orthogonally crossing the second coupling slot in a second direction opposite to the first direction, the power divider being operative for substantially equally dividing a feed signal applied to the signal-feed port into first and second signals respectively coupled from the first and second line portions through the first and second coupling slots to the antenna element, the first and second signals having respective first and second phases differing from each other by substantially $\pi$ radians.

2. The device of claim 1, wherein the antenna element is a quadrilateral metallized area within which the coupling slots are juxtaposed.

3. The device of claim 2, wherein each coupling slot has an I-shaped configuration.

4. The device of claim 2, wherein the power divider is located within and juxtaposed with the metallized area of the antenna element.

5. The device of claim 2, wherein the first and second line portions are parallel to each other and extend perpendicular to the common axis.

6. A multilayered slot-coupled antenna device, comprising in sequence:

a) an antenna element constituting a conductive area;

b) a first dielectric layer;

c) a ground plane having first and second coupling slots formed therein, the coupling slots comprising elongate apertures spaced apart and parallel to each other;

d) a second dielectric layer; and e) first and second feed lines connected to a signal-feed port through a power divider, the first feed line having a first line portion orthogonally crossing the first coupling slot in a first direction, the second feed line having a second line portion orthogonally crossing the second coupling slot in a second direction opposite to the first direction, the power divider being located within an area between the slots and juxtaposed with the conductive area of the antenna element and being operative for substantially equally dividing a feed signal applied to the signal-feed port into first and second signals respectively coupled from the first and second line portions through the first and second coupling slots to the antenna element, the first and second signals having respective first and second phases differing from each other by substantially $\pi$ radians.

7. The device of claim 6, wherein the first and second line portions are elongated and extend along a common axis.

8. A multilayered slot-coupled antenna device, comprising in sequence:

a) an antenna element;

b) a first dielectric layer;

c) a ground plane having first and second coupling slots formed therein, the coupling slots comprising elongate apertures spaced apart and parallel to each other;

d) a second dielectric layer; and e) first and second feed lines connected to a signal-feed port through a power divider, the first feed line having a first line portion orthogonally crossing the first coupling slot in a first direction, the second feed line having a second line portion orthogonally crossing the second coupling slot in a second direction opposite to the first direction, the power divider being operative for substantially equally dividing a feed signal applied to the signal-feed port into first and second signals respectively coupled from the first and second line portions through the first and second coupling slots to the antenna element, the first and second signals having respective first and second phases differing from each other by substantially it radians, the first and second line portions respectively having first and second continuing portions extending parallel to the first and second coupling slots, the first and second continuing portions being spaced apart and parallel to each other.

9. The device of claim 8, wherein the antenna element is a quadrilateral metallized area within which the coupling slots are juxtaposed.

10. The device of claim 8, wherein the first and second line portions are elongated and extend along a common axis.

11. The device of claim 8, wherein the first and second continuing portions point in different directions.

12. The device of claim 8, wherein the first and second continuing portions point in a same direction.

13. The device of claim 8, and a third feed line connected to another signal-feed port and having a third line portion orthogonally crossing a third coupling slot formed in the ground plane.

14. The device of claim 13, wherein the third line portion is located between, and parallel to, the first and second continuing portions.

15. The device of claim 8, and third and fourth feed lines connected to another signal-feed port through another power divider, the third and fourth feed lines having third and fourth line portions orthogonally crossing third and fourth coupling slots formed in the ground plane, the other power divider being operative for substantially equally dividing another feed signal applied to the other signal-feed port into third and fourth signals respectively coupled from the third and fourth line portions through the third and fourth coupling slots to the antenna element, the third and fourth signals having respective third and fourth phases differing from each other by substantially $\pi$ radians.

16. The device of claim 15, wherein the third and fourth coupling slots are parallel to each other.

17. The device of claim 15, wherein the third and fourth line portions respectively have third and fourth continuing portions extending parallel to the third and fourth coupling slots, the third and fourth continuing portions being spaced apart and parallel to each other.

* * * * *

UNITED STATES PATENT AND TRADEMARK OFFICE

CERTIFICATE OF CORRECTION

PATENT NO. : 7,064,712 B2
APPLICATION NO. : 10/469803
DATED : June 20, 2006
INVENTOR(S) : Munk It is certified that error appears in the above-identified patent and that said Letters Patent is hereby corrected as shown below:

In Column 6, Line 39, in Claim 8, delete "it" and insert -- $\pi$ --, therefor.

Signed and Sealed this

Tenth Day of February, 2009

JOHN DOLL
*Acting Director of the United States Patent and Trademark Office*